US005744093A

United States Patent [19]

Davis

[11] Patent Number: 5,744,093

[45] Date of Patent: Apr. 28, 1998

[54] COVER FOR LAUNDERS

[75] Inventor: John Albert Davis, King, Canada

[73] Assignee: Desom Enviromental Systems Limited, Ontario, Canada

[21] Appl. No.: 677,415

[22] Filed: Jul. 9, 1996

[51] Int. Cl.[6] ..... C21B 7/14

[52] U.S. Cl. ..... 266/45; 266/158; 266/196

[58] Field of Search ..... 266/144, 158, 266/196, 231, 166, 44, 45

[56] References Cited

U.S. PATENT DOCUMENTS

| | | | |
|---|---|---|---|
| 3,863,907 | 2/1975 | Pierson, Sr. et al. | 266/196 |
| 4,216,708 | 8/1980 | Wyatt et al. | 266/196 |
| 4,405,363 | 9/1983 | Tivelius | 266/158 |
| 4,720,837 | 1/1988 | Kanada | 266/158 |

*Primary Examiner*—Scott Kastler
*Attorney, Agent, or Firm*—Shoemaker and Mattare Ltd.

[57] ABSTRACT

A cover is provided for a launder, or an equivalent open-topped vessel for containing molten metal, the cover including a heat-insulative layer spanning the open top of the vessel, with a spacer arrangement to maintain a gap of uniform width between the heat-insulative layer and the open-top. A housing defines an evacuation plenum, and connections are made to allow an exhaust device to remove gaseous materials from the plenum. Adjacent the gap is an air-guide arrangement which directs outside air into the evacuation chamber along a path which is intercepted by any gaseous materials exiting through the gap, whereby such gaseous materials are entrained into the evacuation chamber.

19 Claims, 5 Drawing Sheets

COVER FOR LAUNDERS

This invention relates generally to the handling of molten metals, and has to do particularly with the provision, for an open-topped vessel adapted to contain molten metal, of a cover adapted to capture any noxious fumes or materials that might escape from the molten metal.

BACKGROUND OF THIS INVENTION

In the smelting and refining of metals, molten metals and slag may at times be transferred through an open-topped vessel called a launder. This method of hot metal transport has at least five serious drawbacks, namely that:

i) The surface of the metal is exposed to oxygen which can react with components in the metal to either degrade the metal or produce noxious gases and fumes.

ii) Heat losses from the launder transport can cause the metal to cool sufficiently to "freeze", thereby plugging the launder and reducing the effectiveness of the transfer operation.

iii) Heat stresses on launder components, which because of the method of metal production are designed to transport metal periodically, result in high maintenance of the launder structure due to the fluctuating nature of the heating and cooling cycles.

iv) Process operators are subjected to heat stress as the hot metal is at such an elevated temperature that any direct exposure to the metal surface means high radiant heat fluxes to the absorbing bodies.

v) There are high exposure levels of noxious gases and hazardous metal vapours escaping from the surface of the hot metal.

An example is found in the smelting of copper concentrates to anode copper. The industry has evolved a number of process flow sheets which produce, at various points in the process, molten metals with varying concentrations of copper and sulphur. Depending on the particular process flow sheet used, one or more of the hot metal/slag streams have to be transferred from one process operation to another.

This transfer of molten metal is typically performed in open trough type launders which are constructed of either water cooled copper jackets or refractory lined steel jackets, depending on the type of metal which is being handled. Most molten slag transfer operations are handled with the water cooled launders and most matte, blister and anode copper molten metal operations are handled in refractory lined launders. In all of these operations, the molten metal or slag must be maintained above the freezing point of the metal/slag to prevent plugging of the launders.

In some instances this transfer operation is continuous and in other operations it is periodic. In the periodic or batch operations it has been a former practice to open a tap hole and allow transfer of the metal through an open launder. Due to the unprotected nature of the uncovered launder design, heat transfer to the environment is rapid and the metal solidifies on the surface forming a crust which has to be removed, typically after every operation. In addition, oxygen is free to react with the sulphur in the metal and as a result sulphur dioxide is formed which then escapes into the working environment. The convective and radiant heat from such open launder operations also creates heat stress hazards for the operators of these open launders.

As a result, most batch type smelter operations today employ covers over the launders. These covers have taken several forms: from flattened steel barrels, to refractory bricks, to refractory lined steel hinged devices. When used over operating launders, the covers reduce the radiant heat losses and provide some insulation of the molten metal. However, openings in the cover still allow the escape of hot gases and fumes into the working environment and crusts still form because of convective heat loss through the cover. A key feature to the acceptability of these covers is the ease of access to the launders in order that build-up and refractory repairs can be effected conveniently.

With the advent of stricter health and safety regulations, launder covers have evolved to ventilated designs which are connected to secondary exhaust systems and which use negative pressures under the cover to remove fume and hot gases to secondary fume control devices.

It is fundamental to the operation of continuous smelters that the metal not be allowed to freeze and form a crust which would restrict the metal flow. As a result, a variety of covers have been employed which not only insulate the launder and exhaust the fumes, but also provide additional heat along the length of the launder to compensate the heat losses in the transfer operation. The additional heat is usually provided by a series of either pre-mix or inspiration type burners which are distributed along the length of the launder and add products of combustion to the normal fume load which needs to be evacuated.

All of the cover designs described above have thus far proven inadequate for the job. More specifically:

a) The hinged unventilated covers are too unwieldy for convenient access to the launders;

b) The heated ventilated covers have proven too costly to maintain because of the excess heat required to both heat the exhaust air and maintain uniform heat along the length of the launder;

c) Over-firing of the burners in heated covers has led to premature burn-out of the covers, resulting in costly repairs or replacement of the cover components;

d) The most successful covers to date have been those that use refractory bricks to maintain the heat in the launder with separate overhead enclosure type exhaust hoods that use large exhaust volumes to control the fumes which escape from the refractory cover. These exhaust hoods restrict movement around the launders and rely on relatively large volumes of exhaust air to control the large spaces that result between the top of the launder and the overhead exhaust hood;

e) In heated covers, the high surface temperature of the covers and exhaust ducting have led to accidental burns to operators;

f) Hot combustion gases, sulphur dioxide and metal fumes have led to hazardous exposure levels in the work place environment.

GENERAL DESCRIPTION OF THIS INVENTION

Generally, this invention provides a cover and off-gas system for launders and the like, designed to provide superior insulation and heating capabilities and to provide better control of the products of combustion, sulphur dioxide and heavy metal emissions from a typical operation.

More specifically, this invention provides, for use with an open-topped vessel adapted to contain molten metal, a cover comprising:

a heat-insulative layer sized and adapted to span the open top of the vessel, spacer means for maintaining a gap of substantially uniform width between said heat-insulative layer and the open top of the vessel, housing means associated with said layer and defining an evacuation plenum, connection means forming part of said housing means and adapted to allow an exhaust device to exhaust gaseous materials from said evacuation plenum, air-guide means adapted for location adjacent said gap, and adapted to direct outside air into said evacuation plenum such that the path taken by the outside air is intersected by any gaseous materials exiting through said gap, thus entraining such gaseous materials into the evacuation plenum, and expulsion means comprising at least one burner which delivers hot products of combustion to the vessel below the heat-insulative layer, thus adding heat energy to the contents of the vessel while raising the pressure therein, thereby promoting the expulsion of said gaseous materials through said gap.

Further, this invention provides, in combination: 1) an open-topped vessel adapted to contain molten metal, and 2) a cover; the cover comprising:

a heat-insulative layer sized and adapted to span the open top of the vessel, spacer means for maintaining a gap of substantially uniform width between said heat-insulative layer and the open top of the vessel, housing means associated with said layer and defining an evacuation plenum, connection means forming part of said housing means and adapted to allow an exhaust device to exhaust gaseous materials from said evacuation plenum, air-guide means adjacent said gap, and adapted to direct outside air into said evacuation plenum such that the path taken by the outside air is intersected by any gaseous materials exiting through said gap, thus entraining such gaseous materials into the evacuation plenum, and expulsion means for raising the pressure in the vessel, thus promoting the expulsion of said gaseous materials through said gap, said expulsion means comprising at least one burner which delivers hot products of combustion to the vessel below the heat-insulative layer, thus adding heat energy to the contents of the vessel while raising the pressure therein.

Finally, this invention provides a method of transporting molten metal in an open-topped launder, comprising the steps:

1) covering the open top of the launder with a heat-insulative layer sized and adapted to span the open top of the launder,
2) maintaining a gap of substantially uniform width between said heat-insulative layer and the open top of the launder,
3) providing an evacuation plenum adjacently above said layer,
4) utilizing an exhaust device to exhaust gaseous materials from said evacuation plenum, while using air-guide means adjacent said gap to direct outside air into said evacuation plenum such that the path taken by the outside air is intersected by any gaseous materials exiting through said gap, thus entraining such gaseous materials into the evacuation chamber from which they are removed by the exhaust device.

GENERAL DESCRIPTION OF THE DRAWINGS

One embodiment of this invention is illustrated in the accompanying drawings, in which like numerals denote like parts throughout the several views, and in which.

Figure 3A:
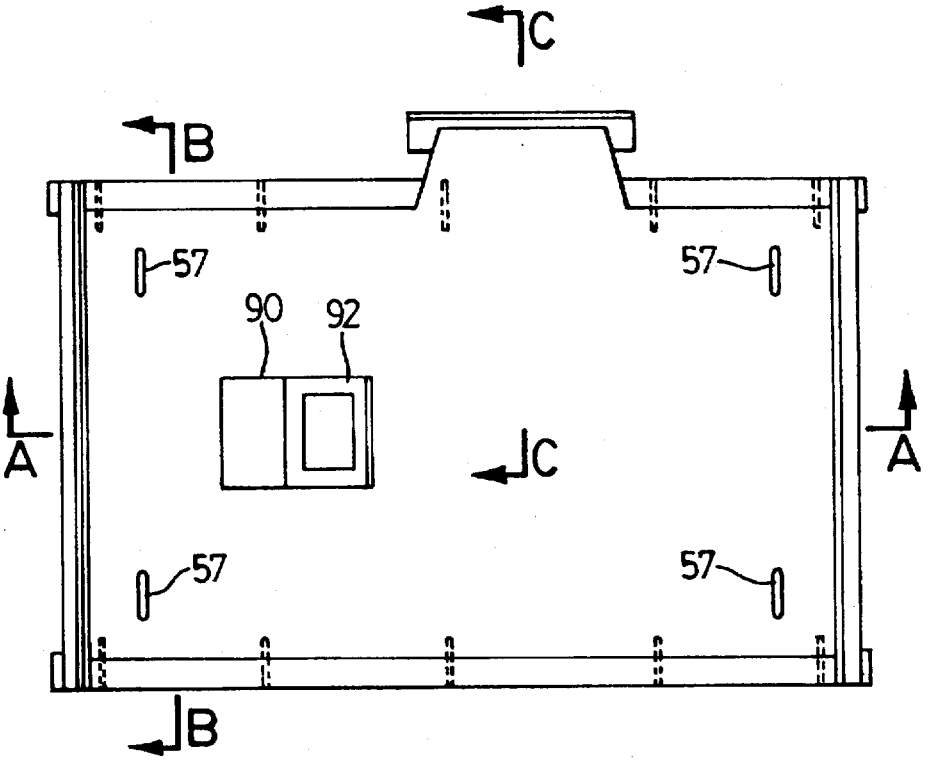
Figure 3B:
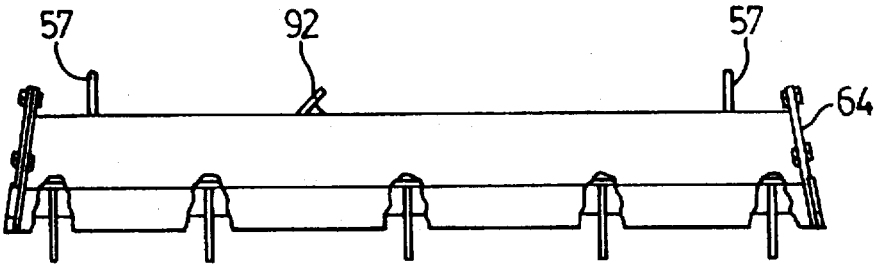

FIG. 3*a* is a top plan view of an individual segment of the cover proposed by this invention;

FIG. 3*b* is a partly broken-away side elevational view of the cover segment shown in FIG. 3*a;*

Figure 4C:
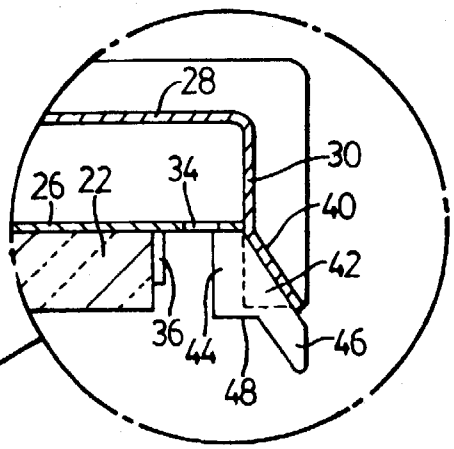
Figure 4B:
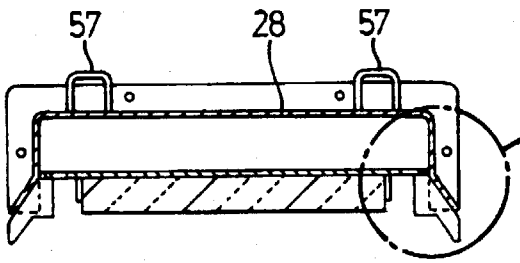
Figure 4D:
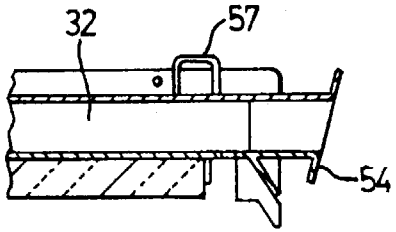
Figure 4A:
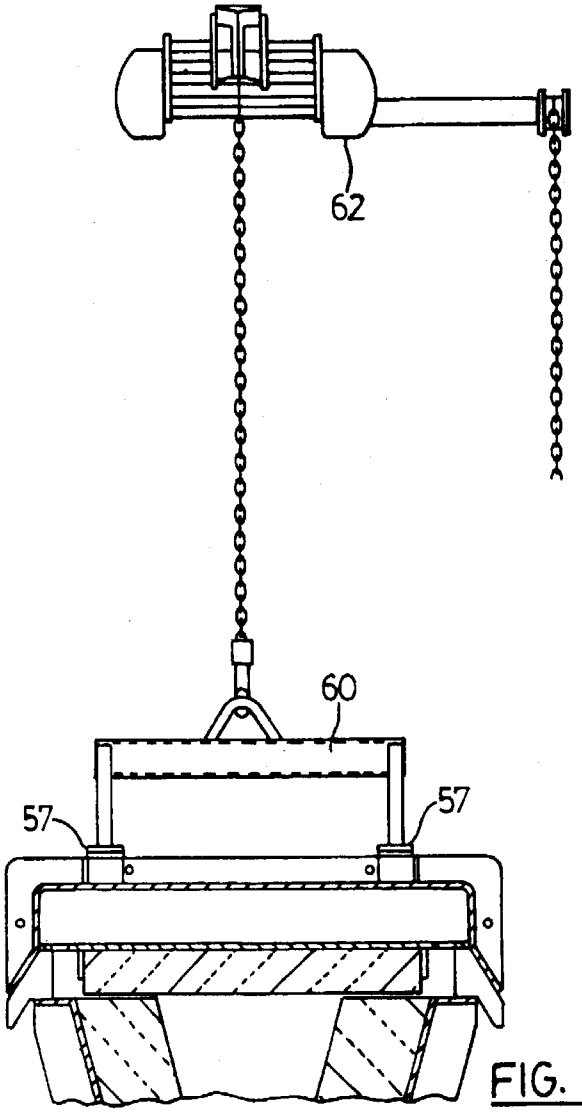

FIG. 4*a* is a part lateral section through a launder with the launder cover of this invention in place, also showing a lifting mechanism for the launder segment in elevation;

FIG. 4*b* is a sectional view taken at the line B—B in FIG. 3*a;*

FIG. 4*c* is a partial transverse sectional view through a cover segment, showing the structure of a sealing flange;

FIG. 4*d* is a partial transverse sectional view taken at the line C—C in FIG. 3*a;*

Figure 5A:
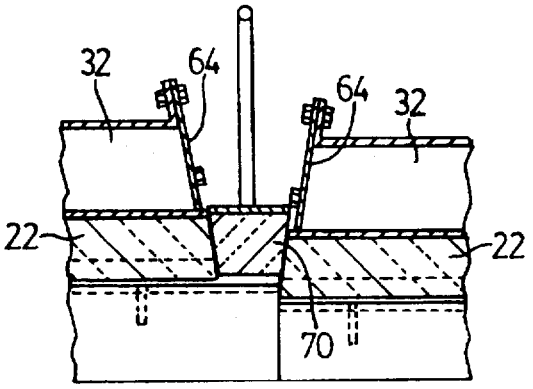
Figure 5B:
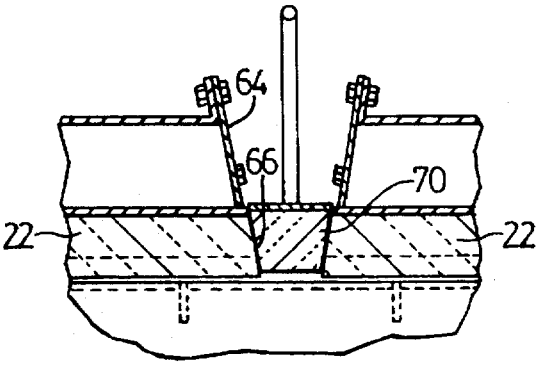
Figure 5C:
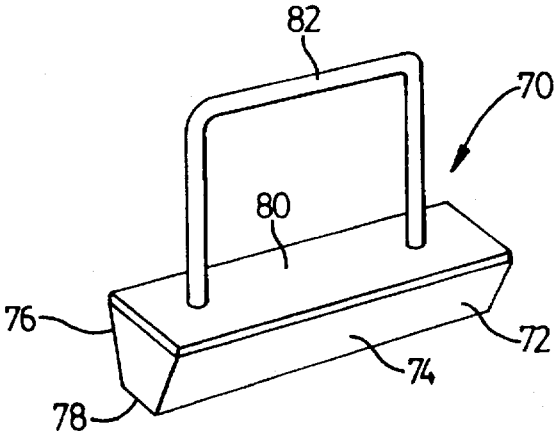
Figure 6:
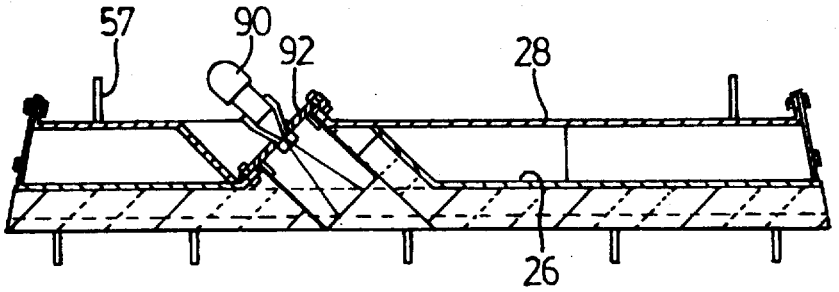
Figure 7:
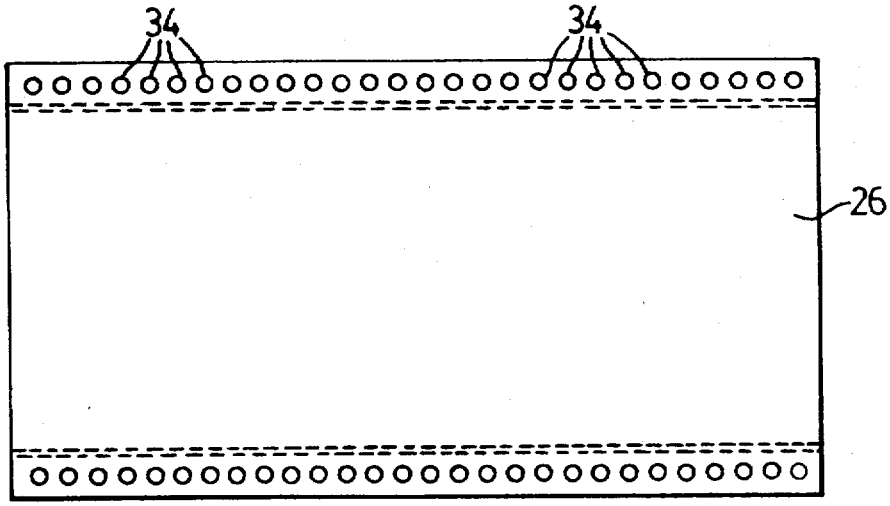
Figure 8:
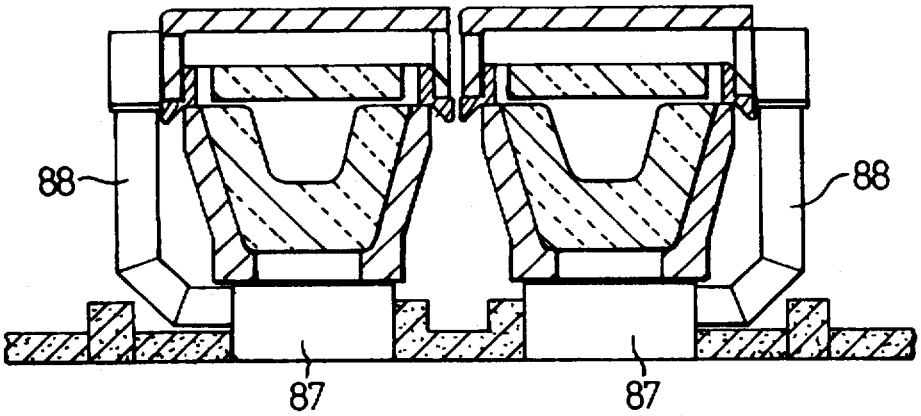

FIGS. 5*a* and 5*b* show a longitudinal vertical section through the joint between two sequential launder cover segments, with the adjacent segments in different alignment arrangements;

FIG. 5*c* is a perspective view of an inspection port plug for use with the launder cover of this invention;

FIG. 6 is longitudinal vertical sectional view through a launder segment, illustrating the mounting of an aspirating burner, the end portion of the section being shown in a greater scale toward the right in FIG. 6;

FIG. 7 is a plan view of a plenum plate showing the distribution of apertures allowing the aspiration of escaping gases; and FIG. 8 is a vertical sectional view taken through a double-launder arrangement, showing the provision of extraction ducts under the launders.

DETAILED DESCRIPTION OF THE DRAWINGS

Figure 1:
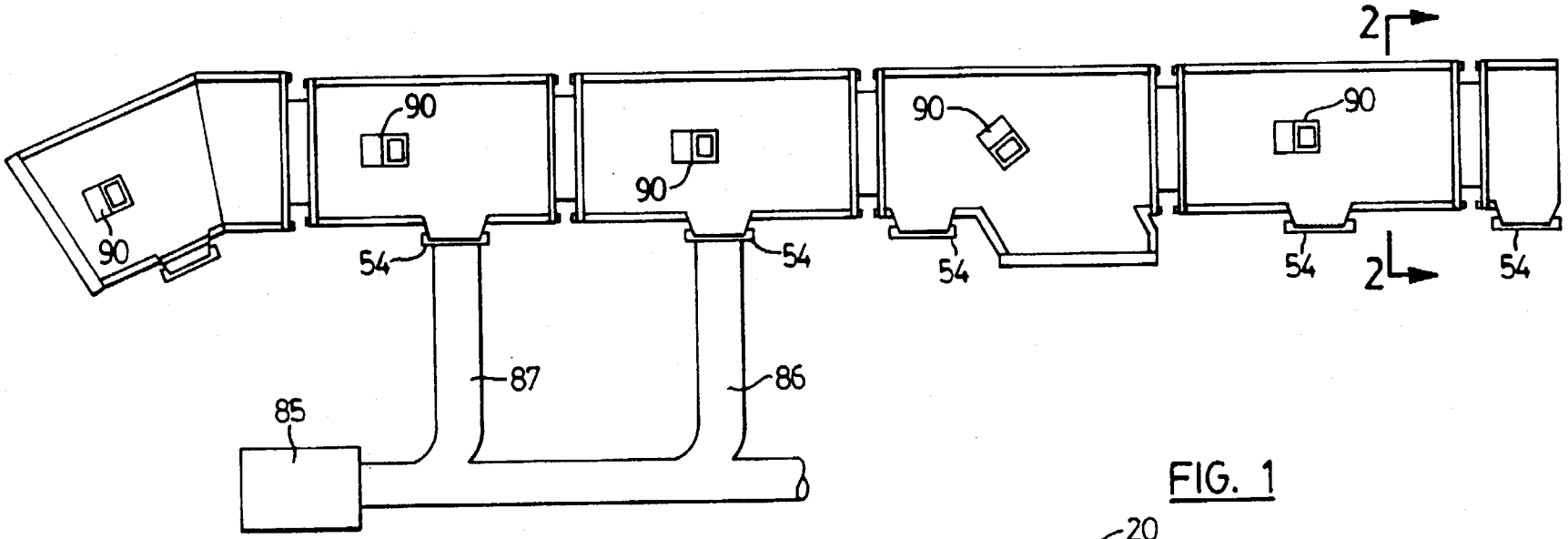
FIG. 1 is a top plan view of a launder to which the cover of the present invention has been applied.

Attention is first directed to FIG. 1, which is a general arrangement view of the invention, showing various segments or elements of the device and their relationship to the launder system.

Figure 2:
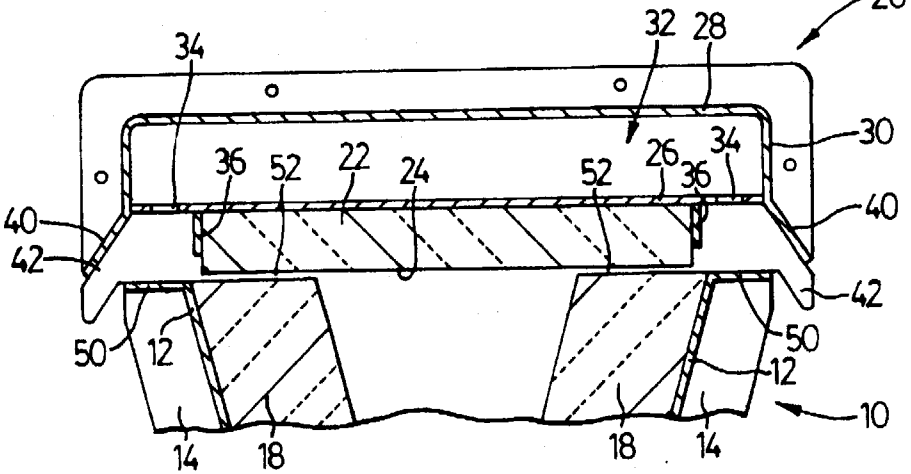
FIG. 2 is a cross-sectional view taken at the line 2—2 in FIG. 1.

Before discussing the broad arrangement of the various segments, it is useful to turn to FIG. 2, for an understanding of the particular configuration of the launder and the cover provided for the launder.

In FIG. 2, a launder 10 has two downwardly and inwardly sloping outer walls 12 supported by external transverse ribs 14 which are located in spaced-apart relation. The outer walls 12 may typically be of steel plate.

The outer walls 12 are internally lined with layers 18 of refractory material.

A cover 12 for the launder 10 is seen to include a heat-insulative layer 22 which has a substantially flat bottom wall 24 closely adjacent but spaced slightly above the tops of the refractory layers 18 (by means described below).

The heat insulative layer 22 of the cover is secured to and supported from a horizontal bottom plate 26, and the latter defines, along with a top wall 28 and side walls 30, an internal plenum 32.

The bottom wall 26, as seen in FIG. 7, is provided with a plurality of flow distribution holes 34 which in this embodiment are of uniform size and spaced equidistantly along the edges of the bottom plate 26. By comparing FIGS. 2 and 7, it will be seen that the heat-insulative layer 22 does not extend laterally far enough to interfere with the holes 34. Lateral limits to the layer 22 are defined by flanges 36 depending downwardly from, and secured to, the underside of the bottom wall 26.

As can be seen by comparing FIGS. 2, 3*b* and 4*b*, the top wall 28 in the embodiment illustrated is continuous and integral with the side walls 30, each of the latter being continuous and integral with a downwardly and outwardly sloping skirt 40, each of the latter being braced and stabilized by the provision of a plurality of spaced-apart guide ribs 42, each of which has a generally rectangular upper portion 44 (see FIG. 4*c*) along with a parallelogram-shaped, downwardly and outwardly projecting portion 46. The rectangular portion 44 includes a horizontal bottom edge 48 which is adapted to rest directly on a horizontal top flange 50 of the launder 10 (as illustrated in FIG. 2).

The skirt 40 serves two functions. The first is to act as an air-guide means which directs outside air inwardly and upwardly, so that it will pass through the holes 34 and into the plenum 32. The outside air, in following this path, must go through a restricted region defined between the skirt 40 and the outside lateral extremity of the adjacent flange 50. Looking particularly at FIG. 2, it will be clear that any combustion gases and other gaseous contamination escaping from the launder 10 must pass along a narrow passageway 52 defined between the heat insulated layer 22 and the refractory layers 18. It is further evident that such escaping gases will directly encounter the inflow of outside air passing between the skirt 40 and the flange 50. As a result, the escaping gases will be entrained in the entering air from outside, and drawn into the plenum 32 through the plurality of holes 34.

It will be further understood that the skirt 40, due to the fact that it extends to a position generally aligned with the horizontal plane of the gap 52, functions as a radiation shield to intercept radiation from the gap.

In order to create a negative pressure in the plenum 32, which is necessary in order to promote an inrush of outside air through the holes 34 and into the plenum, it is necessary to provide a connection which allows an exhaust device to exhaust gaseous materials from the plenum. An appropriate connection for this purpose is seen in FIGS. 1, 3*a* and 4*d*, the latter being a partial vertical sectional view taken at the line C—C in FIG. 3*a*. It will be noted, particularly in FIG. 4*d*, that the exhaust connection is in the form of a sloped exhaust sealing flange 54 which allows a direct connection into the plenum 32. A quick review of FIG. 1 will reveal that such exhaust connection flanges 54 are provided on all of the various shapes of the launder cover segments.

In a preferred embodiment, the launder cover includes expulsion means for raising the pressure within the launder, thus promoting the expulsion of gaseous materials through the gap 52.

The expulsion means is advantageously a burner which receives fuel and combustion air, and which delivers hot products of combustion under pressure to the inside of the launder below the cover, thus pressurizing the gaseous contents of the launder (the gases lying above the molten metal), while at the same time adding heat energy to the contents of the vessel. The burner locations are illustrated at 56.

Seen in FIGS. 3*a*, 3*b*, 4*a*, 4*b* and 4*d* are a plurality of lifting loops 57, typically arranged at the four corners of a rectangle, allowing a lifting rack 60, capable of being raised and lowered by a hoist 62, to engage the loops 57 during application or removal of the cover segment. This is best seen in FIG. 4*a*. As shown in FIG. 4*b* the lifting loops 57 may be configured as U-shaped rods welded or otherwise affixed to the top wall 28.

Turning now to FIGS. 5*a*, 5*b* and 5*c*, it will be seen that each end of the plenum 32 of each segment of the launder cover is provided with a downwardly and outwardly sloping cap 64 which is suitably bolted into place, and that the heat-insulated layer 22 has a correspondingly sloped end 66.

It will be appreciated that the gap between two adjacent segments of the launder cover, particularly that occurring at the edges of the heat insulative layers 22, must be blocked or closed in some fashion, for otherwise the gaseous materials above the molten metal in the launder would preferentially escape through the larger opening between the segments (rather than through the gap 52). For this reason there is supplied a sealing plug 70, best seen in FIG. 5*c*, and seen to include a wedge portion 72 with downwardly and inwardly tapering side walls 74 and 76, a flat bottom wall 78, and a flat top wall which is covered by and secured to a rectangular, horizontal plate 80. Extending vertically upwardly from the plate 80 is a U-shaped lifting bale 82 adapted to be raised by a hoist or the like.

FIG. 5*a* shows the separation wedge 70 in place between the end segments on adjacent edges of two different launders, whereas FIG. 5*b* shows the identical wedge 70 in place between adjacent segments on the same launder.

Returning to FIG. 1, one arrangement of an exhaust device for drawing gaseous materials out of the plenums of the various cover segments is illustrated at 85, and suitable duct work has been shown schematically at 86. Only two of the covers are shown to be connected to the exhaust device 85, but it will be understood that all of the segments require a similar connection.

Alternatively, as illustrated in the double launder arrangement of FIG. 8, horizontal extraction ducts 87 could be located under the elongate launders, with vertical feed ducts 88 connecting the various plenums 32 with the respective ducts 87.

FIG. 6, being a longitudinal section taken at A—A in FIG. 3*a*, illustrates a possible burner arrangement in greater detail. The illustrated device is preferably an aspirating burner 90*a* secured to a cover plate 92, the latter being connected between the top wall 28 and the bottom wall 26, with appropriate structure that will ensure ready access of the burner exhaust into the plenum, while restraining any loss of the plenum contents outwardly through the same location.

In view of the above, a number of features of the present invention clearly distinguish it from other devices currently in use. These features include:

i) The combustion burners in the launder maintain the launder under a positive pressure, relative to the surrounding environment. This feature ensures that even in batch type operations, the thermal shock to the launder structure is reduced as the launder interior is maintained at an elevated temperature.

ii) The gap between the launder and the refractory portion of the cover is sized so that the positive pressure in the launder forces the combustion gases to discharge uniformly out through the gap. In this manner, the heat generated by the burners is distributed along the length of the launder.

iii) The plenum which is constructed above the refractory is maintained under a negative pressure with respect to its surroundings by means of a connection to a launder cover exhaust system which has been sized to pull air into the plenum through the gap established between the plenum and the refractory portion of the hood.

iv) Air entering the gap between the plenum and the hood is directed into the plenum slot by means of a sloping metal guide which accelerates the air past the gap between the refractory and the launder and directs it into the plenum.

This guide then reduces the entrance losses into the plenum which reduces the overall system pressure losses and hence the energy requirements of the exhaust system.

v) Hot combustion gases, sulphur dioxide and metal fumes exiting from the hood in the gap between the launder and the refractory are intimately mixed with the ambient air which is made to sweep these contaminants into the exhaust plenum. Thus there are no contaminants escaping from the hood into the working environment.

vi) As the hot combustion gases are made to mix with ambient air before entering the exhaust plenum, the temperature of the mixture entering the exhaust plenum is greatly reduced, thus eliminating the need for refractory lining of the exhaust hood and ducting.

vii) With a reduced plenum temperature, the entire exposed surface temperature of the components is low enough to prevent accidental burns to the operator.

viii) By allowing the hot combustion gases to exit from the launder area, mix with ambient air in an "external" mixing zone, then be entrained back into the exhaust plenum, the hot combustion gases are not allowed to impinge on any unprotected metal surface, thereby preventing oxidation and premature failure of the structure.

ix) The device in operation allows no leakage of hot contaminated gases into the working environment.

While one embodiment of this invention has illustrated in the accompanying drawings and described hereinabove, it will be evident to those skilled in the art that changes and modifications may be made thereto, without departing from the essence of this invention, as set forth in the accompanying claims.

The embodiments of the invention in which an exclusive property or privilege is claimed are defined as follows:

1. For use with an open-topped vessel adapted to contain molten metal, a cover comprising:

a heat-insulative layer sized and adapted to span the open top of the vessel, spacer means for maintaining a gap of substantially uniform width between said heat-insulative layer and the open top of the vessel, housing means associated with said layer and defining an evacuation plenum, connection means forming part of said housing means and adapted to allow an exhaust device to exhaust gaseous materials from said evacuation plenum, air-guide means adapted for location adjacent said gap, and adapted to direct outside air into said evacuation plenum such that the path taken by the outside air is intersected by any gaseous materials exiting through said gap, thus entraining such gaseous materials into the evacuation plenum, and expulsion means comprising at least one burner which delivers hot products of combustion to the vessel below the heat-insulative layer, thus adding heat energy to the contents of the vessel while raising the pressure therein, thereby promoting the expulsion of said gaseous materials through said gap.

2. The cover claimed in claim 1, in which the housing means defining the evacuation plenum is located directly above the heat-insulative layer and overhangs the edges of the layer wherever the gap exists, the said path of travel of the outside air including a plurality of perforations in the overhanging portion of the housing means adjacent the heat-insulative layer.

3. The cover claimed in claim 1, in which said heat-insulative layer is composed mainly of refractory material.

4. The cover claimed in claim 1, in which said spacer means comprises a plurality of spaced-apart guide ribs secured to the housing means and adapted to rest upon the top of the vessel when the cover is in operation, the guide ribs, when so resting, establishing and maintaining said gap.

5. The cover claimed in claim 1, further comprising a radiation shield which is positioned such that, when the cover is in operation, the shield lies outwardly adjacent the gap and substantially protects adjacent personnel from radiation emerging from the gap.

6. The cover claimed in claim 2, in which said heat-insulative layer is composed mainly of refractory material.

7. The cover claimed in claim 6, in which said spacer means comprises a plurality of spaced-apart guide ribs secured to the housing means and adapted to rest upon the top of the vessel when the cover is in operation, the guide ribs, when so resting, establishing and maintaining said gap.

8. The cover claimed in claim 7, further comprising a radiation shield which is positioned such that, when the cover is in operation, the shield lies outwardly adjacent the gap and shields adjacent personnel from substantially all radiation emerging from the gap.

9. In combination: 1) an open-topped vessel adapted to contain molten metal, and 2) a cover; the cover comprising:

a heat-insulative layer sized and adapted to span the open top of the vessel, spacer means for maintaining a gap of substantially uniform width between said heat-insulative layer and the open top of the vessel, housing means associated with said layer and defining an evacuation plenum, connection means forming part of said housing means and adapted to allow an exhaust device to exhaust gaseous materials from said evacuation plenum, air-guide means adjacent said gap, and adapted to direct outside air into said evacuation plenum such that the path taken by the outside air is intersected by any gaseous materials exiting through said gap, thus entraining such gaseous materials into the evacuation plenum, and expulsion means for raising the pressure in the vessel, thus promoting the expulsion of said gaseous materials through said gap, said expulsion means comprising at least one burner which delivers hot products of combustion to the vessel below the heat-insulative layer, thus adding heat energy to the contents of the vessel while raising the pressure therein.

10. The combination claimed in claim 9, in which the vessel is an elongate vessel, the cover comprising a plurality of separate but similar cover segments, each of the cover segments having its own expulsion means.

11. The combination claimed in claim 10, in which the housing means defining the evacuation plenum is located directly above the heat-insulative layer and overhangs the edges of the layer wherever the gap exists, the said path of travel of the outside air including a plurality of perforations in the overhanging portion of the housing means adjacent the heat-insulative layer.

12. The combination claimed in claim 11, in which said heat-insulative layer is composed mainly of refractory material, and in which said spacer means comprises, for each cover segment, a plurality of spaced-apart guide ribs secured to the housing means and adapted to rest upon the top of the vessel when the cover is in operation, the guide ribs, when so resting, establishing and maintaining said gap; and in which the cover further comprises a radiation shield positioned such that, when the cover is in operation, the shield lies outwardly adjacent the gap and intercepts substantially all radiation emerging from the gap, the shield being a horizontally elongate strip of metal supported by said guide ribs.

13. The combination claimed in claim 10, in which each cover segment has, adjacent at least one end, a downward and outward sloping surface on the heat-insulative layer and a downward and outward sloping cap closing the corresponding end of the housing means; the combination further including at least one tapered plug adapted to fit snugly between two adjacent cover segments.

14. The cover claimed in claim 13, in which said heat-insulative layer is composed mainly of refractory material.

15. A method of transporting molten metal in an open-topped launder, comprising the steps:

1) covering the open top of the launder with a heat-insulative layer sized and adapted to span the open top of the launder, 2) maintaining a gap of substantially uniform width between said heat-insulative layer and the open top of the launder, 3) providing an evacuation plenum adjacently above said layer, 4) utilizing an exhaust device to exhaust gaseous materials from said evacuation plenum, while using air-guide means adjacent said gap to direct outside air into said evacuation plenum such that the path taken by the outside air is intersected by any gaseous materials exiting through said gap, thus entraining such gaseous materials into the evacuation chamber from which they are removed by the exhaust device.

16. The method claimed in claim 15, which further includes utilizing expulsion means to raise the pressure in the launder, thus promoting the expulsion of said gaseous materials through said gap.

17. The method claimed in claim 15, which further includes utilizing at least one fuel burner to deliver hot products of combustion to the launder below the heat-insulative layer, thus adding heat energy to the contents of the launder while raising the pressure therein to promote the expulsion of said gaseous materials through said gap.

18. The method claimed in claim 15, further including substantially blocking the escape of radiant energy from the gap by positioning an elongate radiation shield so as to lie outwardly adjacent the gap and intercept radiation emerging therefrom.

19. The combination claimed in claim 9, further comprising: an exhaust device, said connection means including a substantially horizontal extraction duct located under and parallel with the launder, and a plurality of vertical feed ducts means connecting the evacuation plenum to said extraction duct.

* * * * *